US006962101B2

(12) United States Patent
Granger

(10) Patent No.: US 6,962,101 B2
(45) Date of Patent: Nov. 8, 2005

(54) SAFETY DEVICE FOR STRIP DISPENSING MACHINE

(76) Inventor: Maurice Granger, 17 rue Marcel Pagnol, Saint Priest en Jarez, 42270 (FR)

( * ) Notice: Subject to any disclaimer, the term of this patent is extended or adjusted under 35 U.S.C. 154(b) by 0 days.

(21) Appl. No.: 09/966,028

(22) Filed: Sep. 28, 2001

(65) Prior Publication Data

US 2002/0030075 A1 Mar. 14, 2002

Related U.S. Application Data

(63) Continuation of application No. PCT/FR00/00728, filed on Mar. 23, 2000.

(30) Foreign Application Priority Data

Apr. 2, 1999 (FR) ..... 99 04371

(51) Int. Cl.[7] ..... A47K 10/36; B26D 1/62; B26D 5/38; B65H 20/06; B65H 35/08

(52) U.S. Cl. ..... 83/337; 83/649; 225/16; 242/564.4

(58) Field of Search ..... 474/174, 89; 83/649, 83/650, 331, 334, 335, 337, 339, 949; 226/188; 242/564.4; 225/10, 12, 14, 15, 16

(56) References Cited

U.S. PATENT DOCUMENTS 2,411,917 A * 12/1946 Wooster ..... 226/188
3,961,700 A * 6/1976 Fleischauer ..... 198/790
4,165,138 A * 8/1979 Hedge et al. ..... 242/564.4 X
4,355,715 A * 10/1982 Chorlton ..... 198/790 X
4,635,837 A 1/1987 Granger ..... 225/96
4,846,035 A * 7/1989 Granger ..... 83/649 X
5,217,109 A * 6/1993 Youren ..... 198/790 X
6,152,397 A * 11/2000 Purcell ..... 242/560.1
6,363,824 B1 * 4/2002 Granger ..... 83/334
6,450,076 B1 * 9/2002 Granger ..... 83/334
6,474,209 B1 * 11/2002 Granger ..... 83/649

FOREIGN PATENT DOCUMENTS

EP 0 145 622 * 6/1985 ..... 10/34
EP 0 317 448 B1 4/1991

* cited by examiner

*Primary Examiner*—Clark F. Dexter
(74) *Attorney, Agent, or Firm*—Heslin Rothenberg Farley & Mesiti P.C.

(57) ABSTRACT

A control and safety device for a machine for dispensing strips of material having a belt mounted between a drum (4) and a shaft (9) in a floating mount. The shaft receiving the belt having an axle of narrower diameter than the shaft in its central part opposite a groove formed on the drum. The axle has a dimension greater than the width of the groove (4*b*) formed on the drum, so as to enable an oblique lateral displacement of the belt, which thus accompanies, according to a limited amplitude α, the longitudinal direction in which, for example, a paper strip is being pulled out of the machine by the user.

20 Claims, 1 Drawing Sheet

SAFETY DEVICE FOR STRIP DISPENSING MACHINE

CROSS REFERENCE TO RELATED APPLICATIONS

This application is a continuation of PCT application PCT/FR00/00728 filed on Mar. 23, 2000, which claimed the priority of French application FR 99.04371 filed Apr. 2, 1999.

The invention relates to the technical field of means of dispensing a predetermined length of strip material wound on a reel.

The invention applies to machines for the simultaneous dispensing and cutting of paper, wadding or wipe material in all hand-wipe or toilet paper dispensing applications.

The Applicant has developed many dispensing machines of this type which are defined, in particular, in European Patent 145 622.

A machine of this type comprises a housing having a parallelepiped configuration containing a drum rotatably mounted with respect to the lateral end shields of the housing, this drum being designed to internally accommodate a cutting mechanism with a serrated blade capable of moving out of the drum in a given cycle when the drum rotates as a result of the strip of paper being pulled by a user. A device to start and return the drum described in the Applicant's previous patent makes it possible to cut the strip of material cleanly.

The reel of material located above the drum is held by end shields located either side of the housing of the machine and may or may not rest on the drum.

The strip of material to be dispensed passes over the rear of the drum so that it can be dispensed through a slit in the lower part of the housing.

In order to ensure that the strip of paper or material pulled by the user is ejected from the machine along a satisfactory trajectory, the Applicant has made provision to design the drum with a groove which guides and accommodates an endless transmission belt which is wound around a shaft, said shaft being secured between the lateral sides of the housing and located close to the area of the opening through which the strip of paper is ejected from the bottom of the machine.

This shaft also has a groove which is located in close relationship and in the same plane as the groove on the drum so that, when the drum rotates in order to obtain cutting, said belt spins the shaft and correctly guides the strip of paper towards the outlet of the machine.

The arrangements of this type are described in the above-mentioned European Patent.

Although these arrangements ensure satisfactory operation of the paper strip dispensing machine, there are still nevertheless several drawbacks resulting from the way in which the strip of paper is fed and pulled through the outlet of the dispensing machine by the user.

In fact, the user often tends to pull the strip of paper to the right or left-hand side at a slant and this has the effect of causing the belt to escape from the above-mentioned grooves, thus impeding operation of the machine and sometimes jamming it if the paper tears.

Very often the belt even tends to jump out of the groove and this obviously has an adverse effect on the correct operation of the dispensing machine.

The first solution tried to solve these drawbacks was to increase the tension of the belt in order to prevent it escaping from the groove by keeping it very tight. This first solution had a secondary disadvantage. It was apparent that it became hard to rotate the mechanism for starting the drum and difficulties were encountered in pulling the paper and strip of material in general, especially when the user's hands were wet.

Increasing the tension of the belt was therefore unsatisfactory and made it impossible to use the dispensing machine.

Another approach was to increase the diameter of the edges of the groove on the shaft so as to produce a kind of deep channel intended to prevent the part of the belt in question from escaping if the paper was pulled sideways.

This solution was not entirely satisfactory because, in practice, it became apparent that the middle of the paper was marked and very often split in two pieces either side of the central area when it was cut.

The approach adopted by the Applicant was therefore to attempt to modify the drum/safety shaft connection so as to give a satisfactory solution to the problems encountered, associated with the user pulling the strip of paper emerging from the machine sideways, exerting a greater or lesser tensile force, so as to prevent the belt escaping from its groove.

According to a first aspect of the invention, the control and security device allowing ejection of the strip of material from a strip dispensing machine comprising a drum and a safety shaft which shuts off the lower opening through which the strip of material passes as it leaves the housing and the drum, said drum and said shaft being linked by a means for transmission consisting of a belt, is characterized in that said means of transmission is float mounted between the drum and the shaft, with the central part of the shaft that accommodates said belt and faces the groove on the drum being designed with a dolly axle configuration having a dimension that exceeds the width of the groove on the drum so as to allow limited amplitude, thus tracking the direction in which the strip of paper is pulled longitudinally out of the dispensing machine by the user.

These aspects and others will become apparent from the following description.

The object of the present invention is described, merely by way of example, in the accompanying drawings in which.

Figure 2:
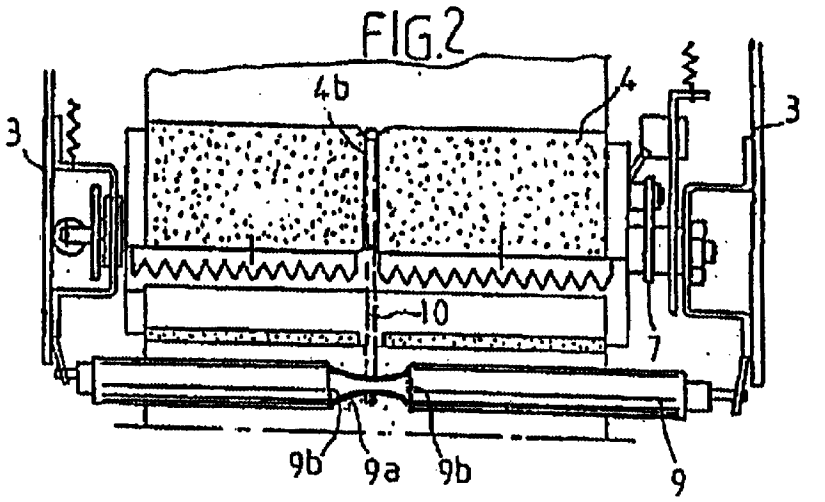
FIG. 2 is a plan cross-sectional view along line 2—2 in FIG. 1.
Figure 3:
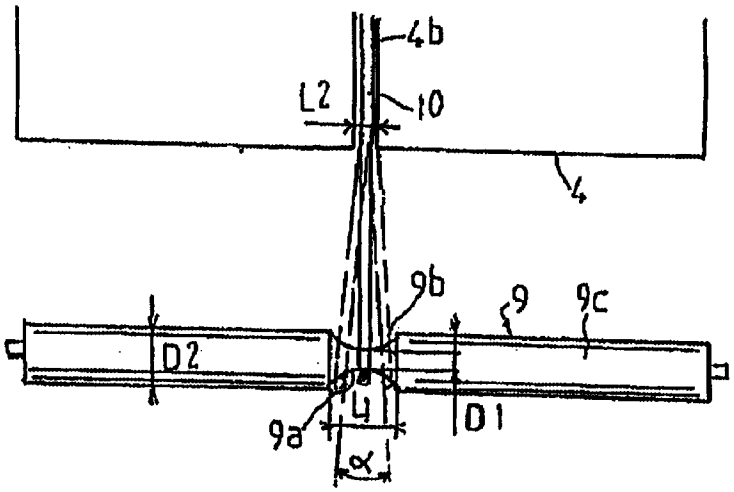
FIG. 3 is a large-scale view of the shaft designed in accordance with the invention showing the position of the belt as a function of different frontal or lateral tensile forces.
Figure 1:
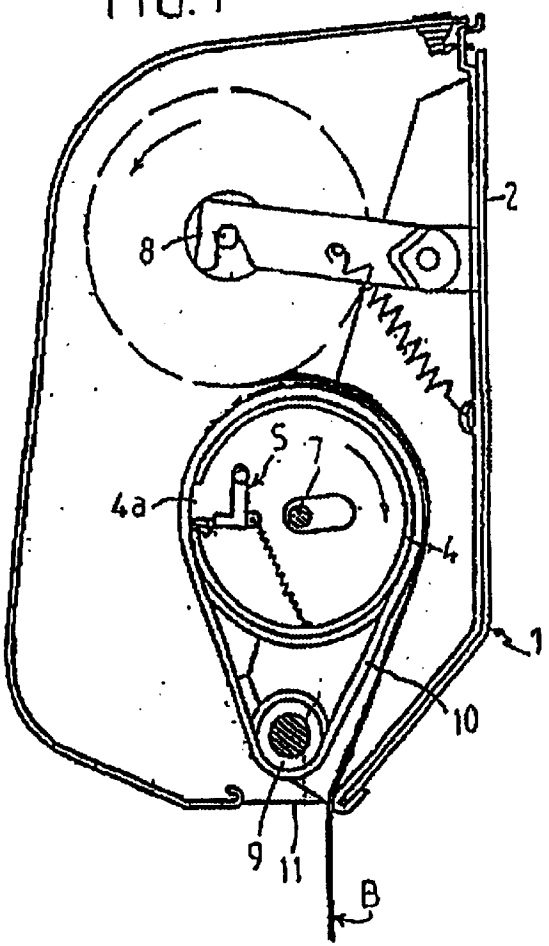
FIG. 1 is a side view of a machine for dispensing strips of material designed in accordance with the invention.

In order that the present invention may more readily be understood, the following description is given, merely by way of example, reference being made to the accompanying drawings.

The dispensing machine is referred to in its entirety as (1). One particular embodiment is described below, merely by way of example, making it possible to adapt the invention.

It comprises a wall-mounted housing (2) having lateral sides or end shields (3) capable of accommodating an internally hollow rotating drum (4) on their lower part.

This drum is capable of accommodating a cutting mechanism (5) capable of moving out of said drum when the drum rotates as the strip of paper is pulled so that said strip of paper can be cut.

The cutting mechanism can be of the type described in the Applicant's patents.

The internally hollow drum has a slit (4*a*) through which the cutting device (5) emerges from the drum.

Laterally and in a known manner, the drum can accommodate a start mechanism (7) of the previously described type.

The strip of material wound on the reel is mounted between the upper end shields (8) so that said reel advantageously rests against the drum.

A control and safety device consisting of a shaft (9) is installed in the lower part of the housing (2) underneath the drum (4) and close to the opening (11) or slit in the housing to allow ejection of the strip of material (B).

This control and safety device consisting of a shaft (9) is capable of accommodating a drive belt (10) which constitutes the means for transmission which, firstly, prevents the unwanted movement of strips of paper between the drum and the shaft and, secondly, forces the strip of paper towards the machine's lower opening.

Drum (4) thus has a groove (4*b*) in its middle part capable of accommodating belt (10) by forming a path over which it slides.

The invention lies in the fact that the middle part of the shaft (9) facing groove (4*b*) on drum (4) has a dolly axle configuration (9*a*) of reduced thickness (D1) compared with the cross section (D2) of shaft (9) to accommodate belt (10).

The length (L1) of this dolly axle configuration is such that it substantially exceeds the width (L2) of the groove on the drum so that it allows, when the strip of paper is pulled by the user, lateral movement of amplitude $\alpha$ and limits the lateral displacement of the belt which therefore is subjected to significant deformation when the strip of paper is pulled in a lateral plane.

Said belt (10) is tensioned so that it is float mounted between drum (4) and safety shaft (9) in order to ensure lateral deflection depending on the way in which the strip of paper is pulled.

Advantageously, the dolly axle (9*a*) shape of the above-mentioned part of the shaft is laterally locked by the walls (9*b*) of the shaft (9) thus forming a shoulder and limit stop so that said belt cannot escape from its groove. The float-mounted belt nevertheless remains held in its extreme position against one of the inside walls of the shaft, it does not jump out and does not move onto the outer periphery (9*c*) of the latter.

This float mounting and limited deflection amplitude of the transmission belt between the drum and the safety shaft makes it possible to use the dispensing machine in any situations where the strip of material is pulled sideways without the machine thereby being jammed.

In addition and incidentally, the groove (4*b*) on the drum may have, in the location of the slit (4*a*) formed in the drum, a slight extra thickness to ensure control of the position of the transmission belt during extreme deflection of the float-mounted belt along the dolly axle shape (9*a*) of the safety shaft (9).

The invention is applicable to all types of machines for dispensing strips of material which include connection by a belt-type transmission between the drum that accommodates a cutting device and a safety shaft located in the lower part of the housing which ensures guided ejection of the strip of material.

Without going beyond the scope of the invention, it is also feasible to double the number of means for transmission that implement the invention. In this case, the drum is designed with a number of grooves which corresponds to the number of transmission belts, and facing them, the safety shaft has an identical number of dolly-axle shapes to ensure the desired operation.

The advantages of the invention are readily apparent.

The simplicity with which this enhancement can be implemented and the fact that it does not increase the cost of manufacturing the dispensing machine and its high reliability are emphasised.

What is claimed is:

1. A paper strip dispensing apparatus comprising:

a housing;

a drum mounted for rotation in the housing, the drum having at least one groove and the at least one groove having a width;

a shaft mounted in the housing adjacent the drum, the shaft mounted for rotation, the shaft having a first outer diameter and a central section having a second outer diameter less than the first outer diameter, and the central section having a non-cylindrical shape and having a length greater than the width of the at least one groove of the drum; and at least one belt mounted on the drum and the shaft, the belt mounted in the at least one groove of the drum and in the central section of the shaft;

wherein the length of the central section of the shaft allows the at least one belt to deflect laterally over an amplitude ($\alpha$) when a paper strip is pulled laterally from the paper strip dispensing apparatus.

2. The paper strip dispensing apparatus as recited in claim 1, wherein the drum comprises an axis of rotation and the shaft comprises an axis of rotation, and wherein the axis of rotation of the shaft is substantially parallel to the axis of rotation of the drum.

3. The paper strip dispensing apparatus as recited in claim 1, wherein the central section comprises shoulders, the shoulders adapted to prevent the lateral movement of the at least one belt beyond the central section.

4. The paper strip dispensing apparatus as recited in claim 2, wherein the central section comprises shoulders, the shoulders adapted to prevent the lateral movement of the at least one belt beyond the central section.

5. The paper strip dispensing apparatus as recited in claim 1, wherein the at least one belt consists of a belt.

6. The paper strip dispensing apparatus as recited in claim 1, wherein the paper strip comprises one of a hand-wipe and toilet paper.

7. The paper strip dispensing apparatus as recited in claim 1, wherein the housing is a wall-mounted housing.

8. The paper strip dispensing apparatus as recited in claim 1, wherein the drum further comprises a strip-cutting mechanism.

9. The paper strip dispensing apparatus as recited in claim 1, wherein the drum comprises a hollow drum.

10. The paper strip dispensing apparatus as recited in claim 9, wherein the hollow drum further comprises a strip-cutting mechanism.

11. The paper strip dispensing apparatus as recited in claim 1, wherein the central section comprises a dolly axle.

12. The paper strip dispensing apparatus as recited in claim 1, wherein the at least one belt is mounted between the drum and the shaft to permit lateral deflection of the belt when the paper strip is dispensed from the apparatus.

13. The paper strip dispensing apparatus as recited in claim 1, further comprising a reel mounted to the housing for holding paper strip mounted in the housing.

14. The paper strip dispensing apparatus as recited in claim 1, wherein the housing comprises an opening for dispensing the paper strip, and wherein the shaft at least partially obstructs the opening.

15. The paper strip dispensing apparatus as recited in claim 1, wherein the central section comprises a smooth, curvilinear surface extending in a longitudinal direction over which the at least one belt laterally deflects.

16. A paper strip dispensing apparatus comprising:

a housing;

a drum mounted for rotation in the housing, the drum having at least one groove and the at least one groove having a width; and a control and safety device comprising:

a shaft mounted in the housing adjacent the drum, the shaft mounted for rotation, the shaft having a first outer diameter and a central section having a second outer diameter less than the first outer diameter, and the central section having a non-cylindrical shape and having a length greater than the width of the at least one groove of the drum; and at least one belt mounted on the drum and the shaft, the belt mounted in the at least one groove of the drum and in the central section of the shaft;

wherein the length of the central section of the shaft allows the at least one belt to deflect laterally over an amplitude ($\alpha$) when a paper strip is pulled laterally from the paper strip dispensing apparatus.

17. The paper strip dispensing apparatus as recited in claim 16, wherein the drum comprises an axis of rotation and the shaft comprises an axis of rotation, and wherein the axis of rotation of the shaft is substantially parallel to the axis of rotation of the drum.

18. The paper strip dispensing apparatus as recited in claim 16, wherein the drum further comprises a strip-cutting mechanism.

19. A paper strip dispensing apparatus comprising:

a housing;

a drum mounted for rotation in the housing, the drum having an axis and at least one groove and the at least one groove having a width;

a shaft mounted in the housing adjacent the drum, the shaft mounted for rotation, the shaft having an axis substantially parallel to the axis of the drum, a first outer diameter, and a central section having a second outer diameter less than the first outer diameter, and the central section having a non-cylindrical shape and having a length greater than the width of the at least one groove of the drum and wherein the central section comprises a smooth, curvilinear surface extending in a longitudinal direction; and at least one belt mounted on the drum and the shaft, the belt mounted in the at least one groove of the drum and in the central section of the shaft;

wherein the length of the central section of the shaft allows the at least one belt to deflect laterally over an amplitude ($\alpha$) when a paper strip is pulled laterally from the paper strip dispensing apparatus.

20. The paper strip dispensing apparatus as recited in claim 19, wherein the smooth, curvilinear surface is radiused in the longitudinal direction.

* * * * *